US012611576B1

(12) United States Patent
Nunez et al.

(10) Patent No.: US 12,611,576 B1
(45) Date of Patent: Apr. 28, 2026

(54) GOLF CLUB HEAD WITH A STRESS-REDUCING STRUCTURE

(71) Applicant: Topgolf Callaway Brands Corp., Carlsbad, CA (US)

(72) Inventors: Christopher Nunez, Escondido, CA (US); Michael Hallack, Carlsbad, CA (US); Brandon DeMille, Carlsbad, CA (US); William Watson, Menifee, CA (US); Dominic LeBlanc, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 328 days.

(21) Appl. No.: 18/406,626

(22) Filed: Jan. 8, 2024

Related U.S. Application Data

(63) Continuation-in-part of application No. 18/377,226, filed on Oct. 5, 2023, now Pat. No. 12,318,669, which is a continuation of application No. 18/212,612, filed on Jun. 21, 2023, now Pat. No. 11,786,784.

(60) Provisional application No. 63/444,874, filed on Feb. 10, 2023, provisional application No. 63/443,654, filed on Feb. 6, 2023, provisional application No. 63/433,181, filed on Dec. 16, 2022.

(51) Int. Cl.
*A63B 53/04* (2015.01)

(52) U.S. Cl.
CPC ..... *A63B 53/0433* (2020.08); *A63B 53/0437* (2020.08); *A63B 53/0412* (2020.08); *A63B 53/0466* (2013.01); *A63B 2209/02* (2013.01)

(58) Field of Classification Search
CPC . A63B 53/04; A63B 53/0433; A63B 53/0437; A63B 53/0466
See application file for complete search history.

(56) References Cited

U.S. PATENT DOCUMENTS 4,449,707 A * 5/1984 Hayashi ..... A63B 53/04 473/305
5,154,425 A * 10/1992 Niskanen ..... A63B 53/04 473/342
5,364,571 A * 11/1994 O'Connor ..... C04B 35/622 264/29.7
6,471,604 B2 * 10/2002 Hocknell ..... A63B 53/02 473/345

(Continued)

FOREIGN PATENT DOCUMENTS

JP 2008006225 A * 1/2008
TW M294958 U * 8/2006
WO WO-2024129166 A1 * 6/2024 ..... A63B 53/0437

*Primary Examiner* — Alvin A Hunter
(74) *Attorney, Agent, or Firm* — Michael A. Catania; Daniel Moderick

(57) ABSTRACT

A golf club head with a face component with a stiffening member is disclosed herein. The golf club having products of inertia Ixy and Ixz with absolute values below 100 g-cm$^2$ and a positive product of inertia Iyz is disclosed herein. The golf club has a large volume, a high moment of inertia, or both. Preferably, the moment of inertia, Izz, of the golf club head about a vertical axis Z through the center of gravity ranges from 3000 g-cm$^2$ to 5000 g-cm$^2$, and a moment of inertia, Iyy, about a horizontal axis Y through the center of gravity of the golf club head is greater than 1900 g-cm$^2$.

3 Claims, 21 Drawing Sheets

(56) References Cited

U.S. PATENT DOCUMENTS 6,672,975 B1 * 1/2004 Galloway ..... A63B 53/0466 473/349
6,723,279 B1 * 4/2004 Withers ..... A63B 53/04 419/14
7,070,517 B2 * 7/2006 Cackett ..... A63B 53/0466 473/348
7,137,907 B2 * 11/2006 Gibbs ..... A63B 53/0466 473/345
7,147,576 B2 * 12/2006 Imamoto ..... A63B 53/0466 473/335
7,163,470 B2 * 1/2007 Galloway ..... A63B 60/02 473/345
7,410,428 B1 * 8/2008 Dawson ..... A63B 60/00 473/345
7,413,520 B1 * 8/2008 Hocknell ..... A63B 60/02 473/345
7,419,442 B1 * 9/2008 Alan ..... A63B 60/02 473/345
7,431,666 B2 * 10/2008 Vincent ..... A63B 53/0466 473/345
7,431,667 B2 * 10/2008 Vincent ..... A63B 53/0466 473/348
7,503,854 B2 * 3/2009 Galloway ..... A63B 60/02 473/348
7,549,935 B2 * 6/2009 Foster ..... A63B 53/0466 473/335
7,749,097 B2 * 7/2010 Foster ..... A63B 60/02 473/335
8,430,986 B1 * 4/2013 Galloway ..... A63B 60/00 156/189
8,491,416 B1 * 7/2013 Demille ..... A63B 53/04 473/348
8,979,671 B1 * 3/2015 DeMille ..... A63B 60/00 473/335
9,757,629 B2 * 9/2017 Seluga ..... A63B 53/0466
9,868,036 B1 * 1/2018 Kleinert ..... A63B 53/06
9,908,014 B1 * 3/2018 Wester ..... A63B 60/52
10,035,049 B1 * 7/2018 Nielson ..... A63B 60/52
10,086,240 B1 * 10/2018 Hoffman ..... A63B 60/00
10,369,435 B1 * 8/2019 Myers ..... F16G 11/12
10,406,414 B2 * 9/2019 Galvan ..... A63B 60/00
10,981,040 B2 * 4/2021 Nunez ..... A63B 53/045
11,364,423 B2 * 6/2022 Nunez ..... A63B 53/0408
11,786,784 B1 * 10/2023 DeMille ..... A63B 53/0437 473/347
12,318,669 B2 * 6/2025 DeMille ..... A63B 53/0454
12,318,670 B2 * 6/2025 DeMille ..... A63B 53/0454
2005/0233831 A1 * 10/2005 Ezaki ..... A63B 60/02 473/345
2005/0288124 A1 * 12/2005 Galloway ..... A63B 53/0466 473/345
2006/0079345 A1 * 4/2006 Gibbs ..... A63B 53/0466 473/345
2007/0004531 A1 * 1/2007 Galloway ..... A63B 60/02 473/345
2007/0293348 A1 * 12/2007 Hocknell ..... A63B 53/047 473/349
2008/0220893 A1 * 9/2008 Dawson ..... A63B 60/00 473/345
2008/0220895 A1 * 9/2008 Vincent ..... A63B 60/02 473/350
2008/0220896 A1 * 9/2008 Alan ..... A63B 53/0466 473/350
2008/0220897 A1 * 9/2008 Vincent ..... A63B 60/00 473/350
2008/0220898 A1 * 9/2008 Hocknell ..... A63B 53/0466 473/350
2009/0088272 A1 * 4/2009 Foster ..... A63B 60/00 473/345
2009/0143168 A1 * 6/2009 Bennett ..... A63B 60/02 473/345
2010/0048316 A1 * 2/2010 Honea ..... A63B 53/0466 473/282
2010/0151961 A1 * 6/2010 Galloway ..... A63B 60/02 473/345
2010/0178997 A1 * 7/2010 Gibbs ..... A63B 53/0466 473/345
2012/0270676 A1 * 10/2012 Burnett ..... A63B 60/00 473/346
2013/0324299 A1 * 12/2013 Clausen ..... A63B 53/047 473/409
2015/0094164 A1 * 4/2015 Galvan ..... A63B 60/54 473/329
2017/0340932 A1 * 11/2017 Morales ..... A63B 53/0466
2018/0085644 A1 * 3/2018 Kawaguchi ..... A63B 60/52
2018/0345099 A1 * 12/2018 Harbert ..... A63B 53/0433
2019/0151721 A1 * 5/2019 Morales ..... A63B 53/0475
2019/0224533 A1 * 7/2019 Spackman ..... A63B 53/045
2020/0114229 A1 * 4/2020 Milleman ..... A63B 53/0466
2020/0122003 A1 * 4/2020 Milleman ..... A63B 53/0408
2021/0162280 A1 * 6/2021 Morales ..... A63B 53/0466
2021/0339096 A1 * 11/2021 Milleman ..... A63B 60/02
2022/0401801 A1 * 12/2022 Cleghorn ..... A63B 60/002

* cited by examiner

GOLF CLUB HEAD WITH A STRESS-REDUCING STRUCTURE

CROSS REFERENCES TO RELATED APPLICATIONS

The Present Application claims priority to U.S. Provisional Patent Application No. 63/443,654, filed on Feb. 6, 2023, U.S. Provisional Patent Application No. 63/444,874, filed on Feb. 10, 2023, and is a continuation-in-part application of U.S. patent application Ser. No. 18/377,226, filed on Oct. 5, 2023, which is a continuation application of U.S. patent application Ser. No. 18/212,612, filed Jun. 21, 2023, now U.S. Pat. No. 11,786,784, issued on Oct. 17, 2023, which claims priority to U.S. Provisional Patent Application No. 63/444,167 filed on Feb. 8, 2023, and claims priority to U.S. Provisional Patent Application No. 63/433,181 filed on Dec. 16, 2022, each of which is hereby incorporated by reference in its entirety

STATEMENT REGARDING FEDERALLY SPONSORED RESEARCH OR DEVELOPMENT

Not Applicable

BACKGROUND OF THE INVENTION

Field of the Invention

The present invention relates to a golf club head. More specifically, the present invention relates to a golf club head with a stress-reducing stiffening member disposed proximate a striking face and preferably composed of a high-strength material such as titanium alloy.

Description of the Related Art

The prior art discloses various golf club heads having interior structures. For example, Kosmatka, U.S. Pat. No. 6,299,547 for a Golf Club Head with an Internal Striking Plate Brace, discloses a golf club head with a brace to limit the deflection of the striking plate. Yabu, U.S. Pat. No. 6,852,038 for a Golf Club Head and Method of Making the Same, discloses a golf club head with a sound bar. Galloway, U.S. Pat. No. 7,118,493 for a Multiple Material Golf Club Head discloses a golf club head with a composite aft body having an interior sound component extending upward from a sole section of a metal face component. Seluga et al., U.S. Pat. No. 8,834,294 for a Golf Club Head with Center of Gravity Adjustability discloses a golf club head with a tube having a mass for adjusting the CG of a golf club head. Dawson et al., U.S. Pat. No. 8,900,070 for a Weighted Golf Club Head discloses a golf club head with an interior weight lip extending from the sole towards the face. However, the prior art fails to disclose an interior structure that increases ball speed and reduces stress in the face at impact, with a minimal increase in mass to the golf club head, and that can be adjusted to preload the golf club head.

Prior jailbreak geometries involved two bars that connect the crown and sole of the golf club head. This was done to create an advantage in CT/COR relationship. The mass of multiple bars made it harder to achieve advantageous mass properties.

BRIEF SUMMARY OF THE INVENTION

The present invention achieves a similar CT/COR advantage while requiring less mass to do so, allowing for that mass to be placed in more advantageous locations for increased performance.

The present invention is a single cartridge design that is created through the wax welding process. The feature turns into a single yet wider bar. The feature is concentrated more towards the center of the head and is optimized for weight savings.

The feature turns into a single yet larger bar instead of two bars. The feature is concentrated more towards the center of the head which allows it to have a more significant effect on reducing CT consequently allowing for more mass to be saved.

One aspect of the present invention is a golf club head. The golf club head comprises a face component, a central body component and an aft-component. The component comprises a crown portion and a sole portion. The crown portion is composed of a continuous carbon fiber reinforced epoxy material. The crown portion has a thickness ranging from 0.025 inch to 0.040 inch. The sole portion is composed of a chopped carbon fiber reinforced vinyl ester sheet molding compound material. The sole portion has a thickness ranging from 0.040 inch to 0.240 inch. The crown portion is attached to the sole portion, The component has a front opening and a rear opening with a hollow interior. The face component is attached to a front opening of the central body and the aft component is attached to a rear opening of the central body.

Having briefly described the present invention, the above and further objects, features, and advantages thereof will be recognized by those skilled in the pertinent art from the following detailed description of the invention when taken in conjunction with the accompanying drawings.

DETAILED DESCRIPTION OF THE INVENTION

Figure 1:
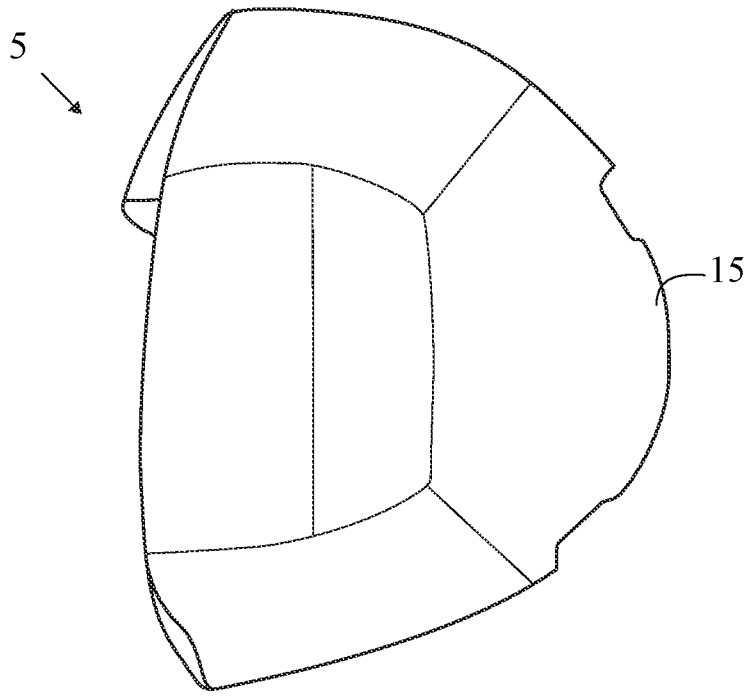
FIG. 1 is a top plan view of a component of a golf club head.
Figure 2:
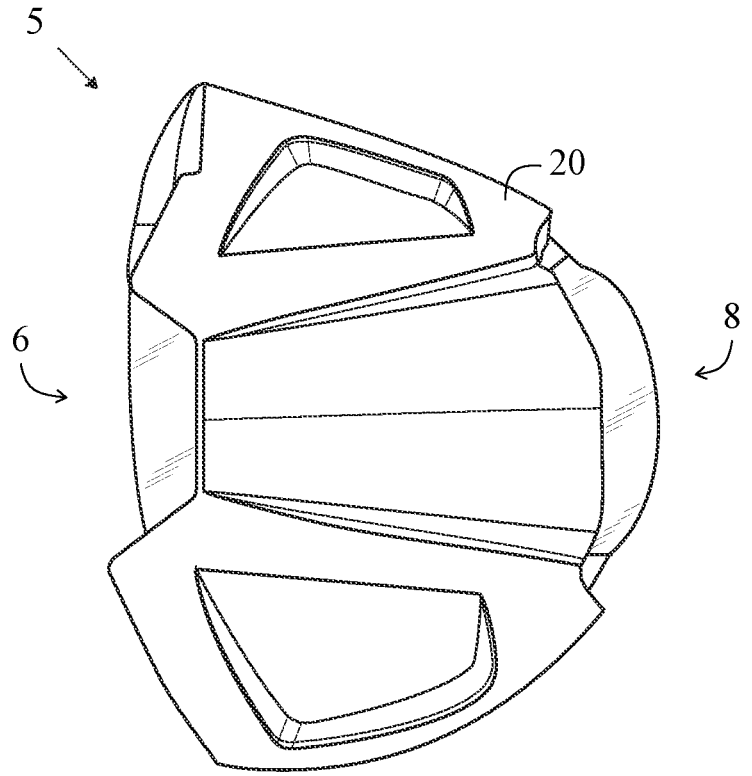
FIG. 2 is a bottom plan view of the component of FIG. 1.
Figure 3:
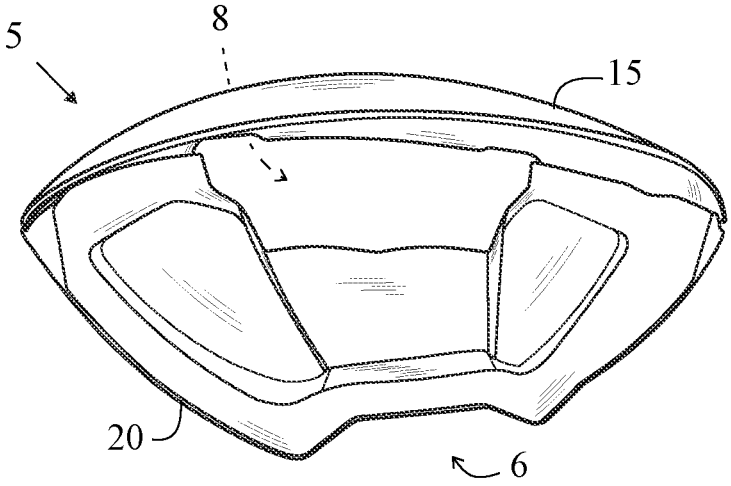
FIG. 3 is a front elevation view of the component of FIG. 1.
Figure 4:
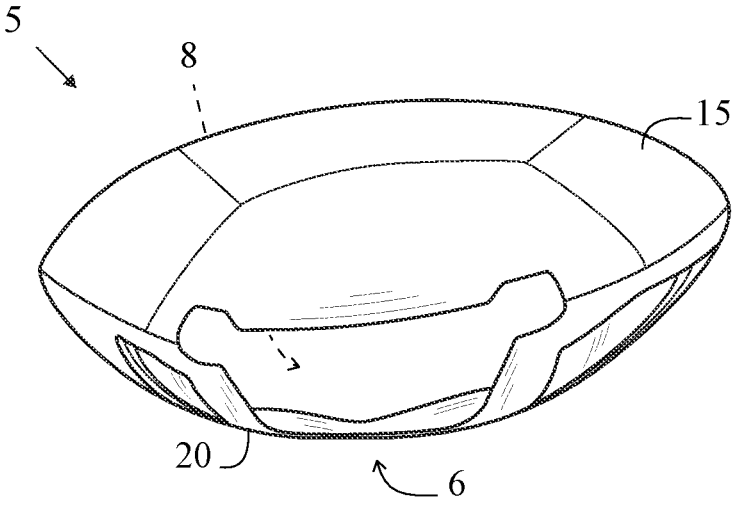
FIG. 4 is a rear elevation view of the component of FIG. 1.
Figure 5:
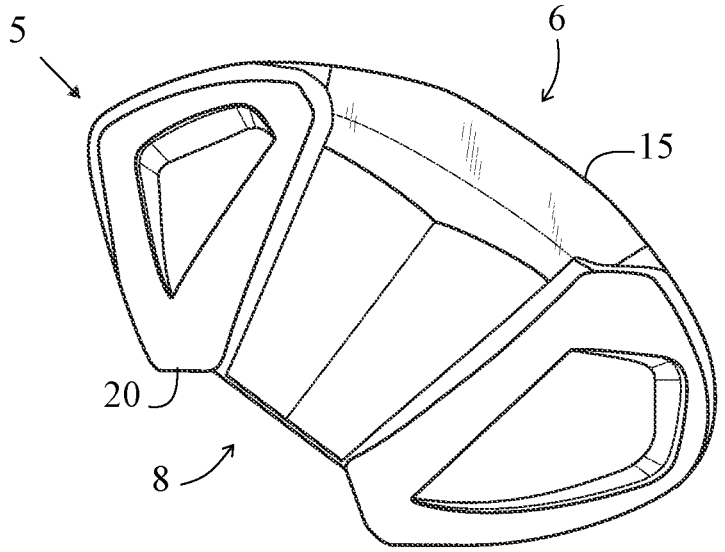
FIG. 5 is a bottom perspective view of the component of FIG. 1.
Figure 6:
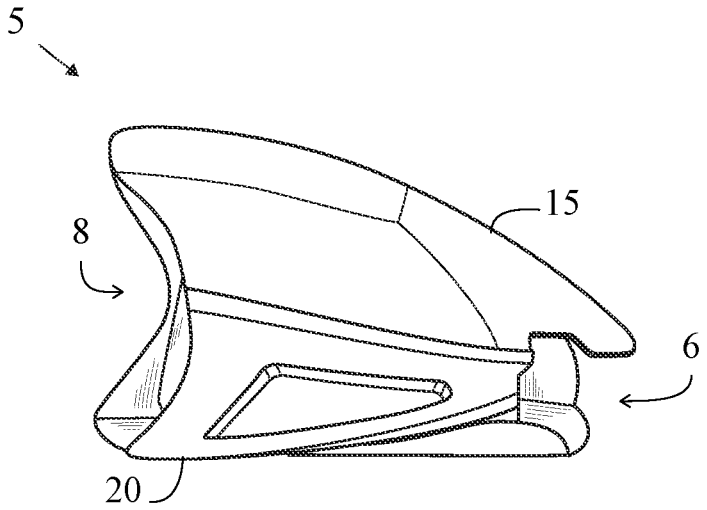
FIG. 6 is a side elevation view of the component of FIG. 1.

As shown in FIGS. 1-8, a component 5 for a golf club head comprises a crown portion 15 and a sole portion 20. The crown portion 15 is composed of a continuous carbon fiber reinforced epoxy material and has a thickness ranging from 0.025 inch to 0.040 inch. The sole portion 20 is composed of a chopped carbon fiber reinforced vinyl ester sheet molding compound material and has a thickness ranging from 0.040 inch to 0.240 inch. The crown portion 15 is attached to the sole portion 20. The component 5 has a front opening 6 and a rear opening 8 with a hollow interior.

Figure 7:
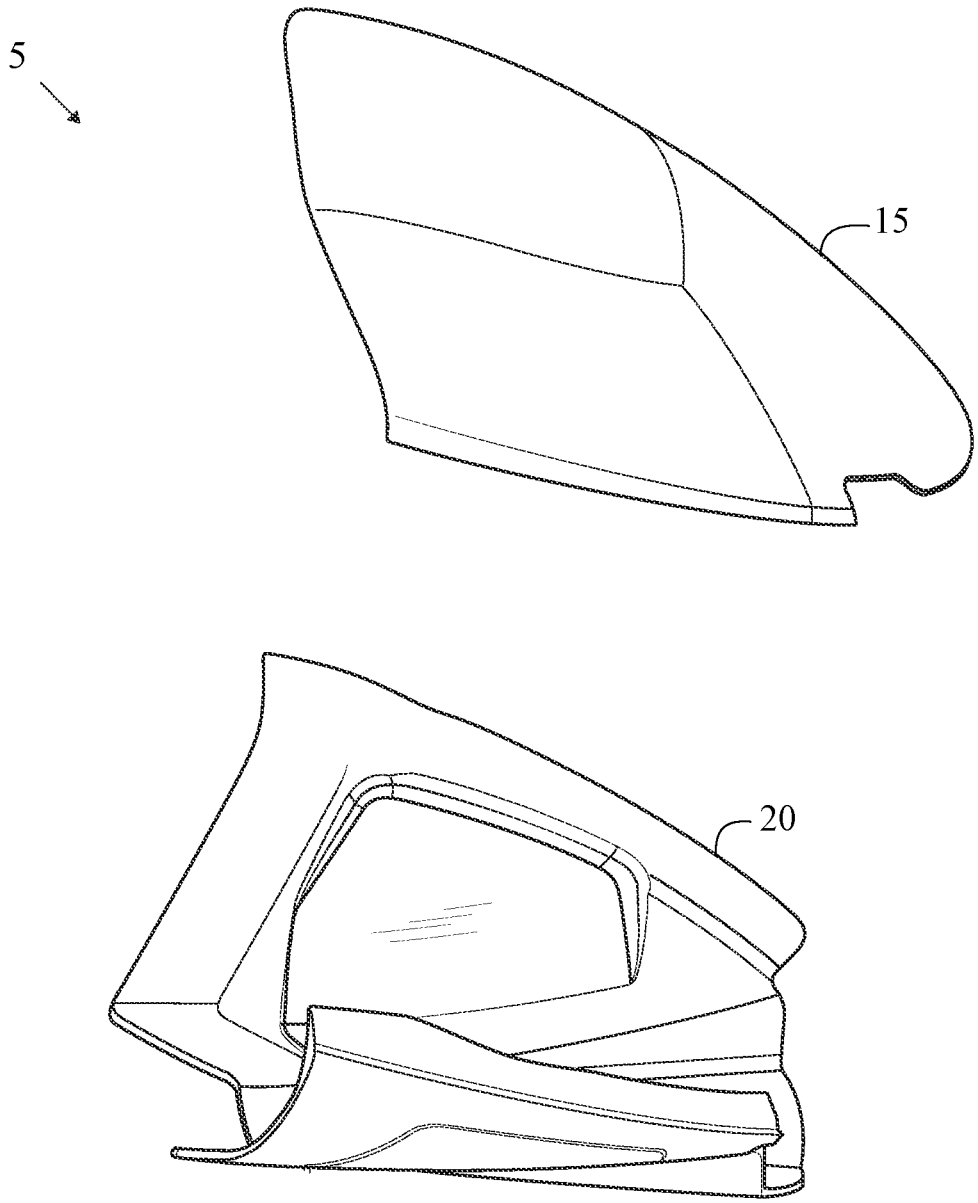
FIG. 7 is an exploded view of the component of FIG. 1.

FIG. 7 is an exploded view of the component 5.

Figure 8:
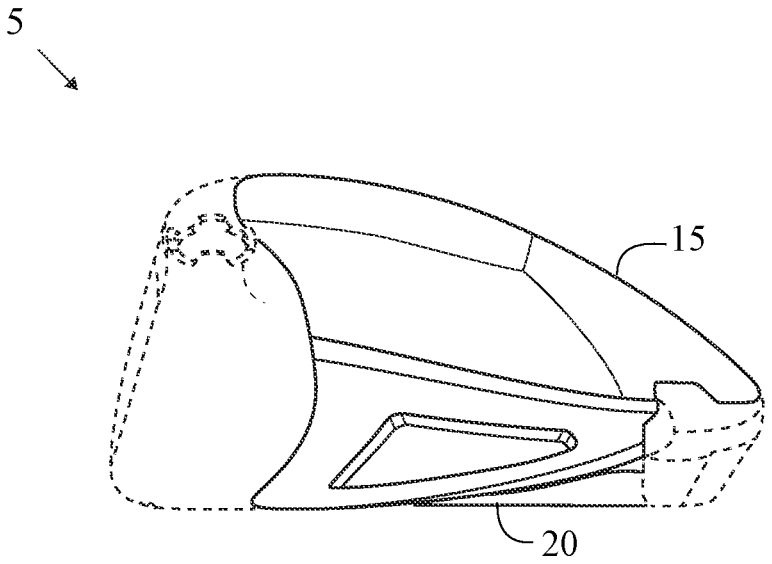
FIG. 8 is a side elevation view of the component of FIG. 1 with a face component and rear weighting component in dashed lines.

FIG. 8 shows the component 5 with a face component attached to a central body and a rear weighting component, both in dashed lines.

Preferably, the sole portion is thicker than the crown portion.

Preferably. the first carbon based material has continuous fibers and the second carbon based material has chopped fibers.

Figure 9:
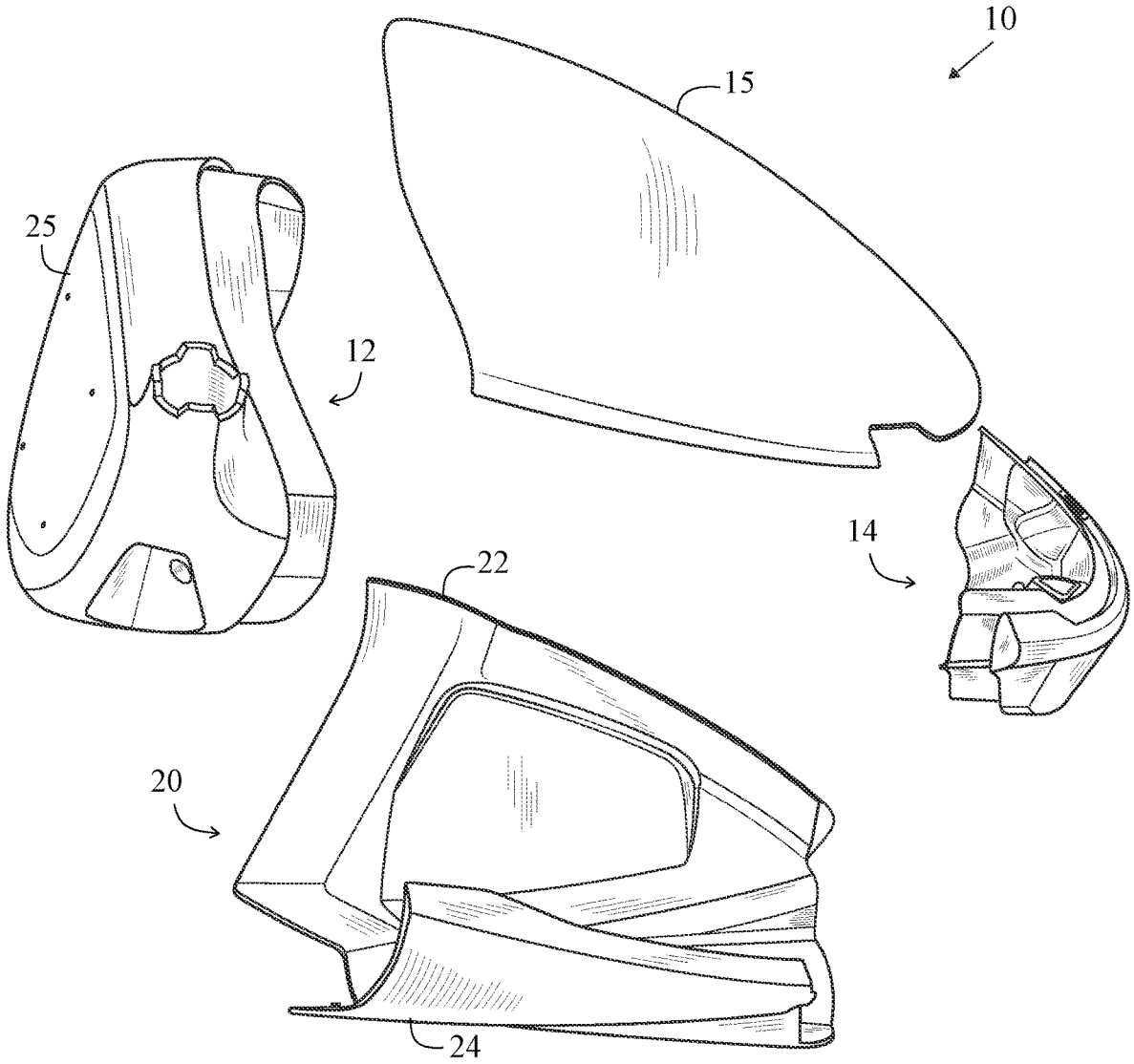
FIG. 9 is an exploded view of a multiple component golf club head.
Figure 10:
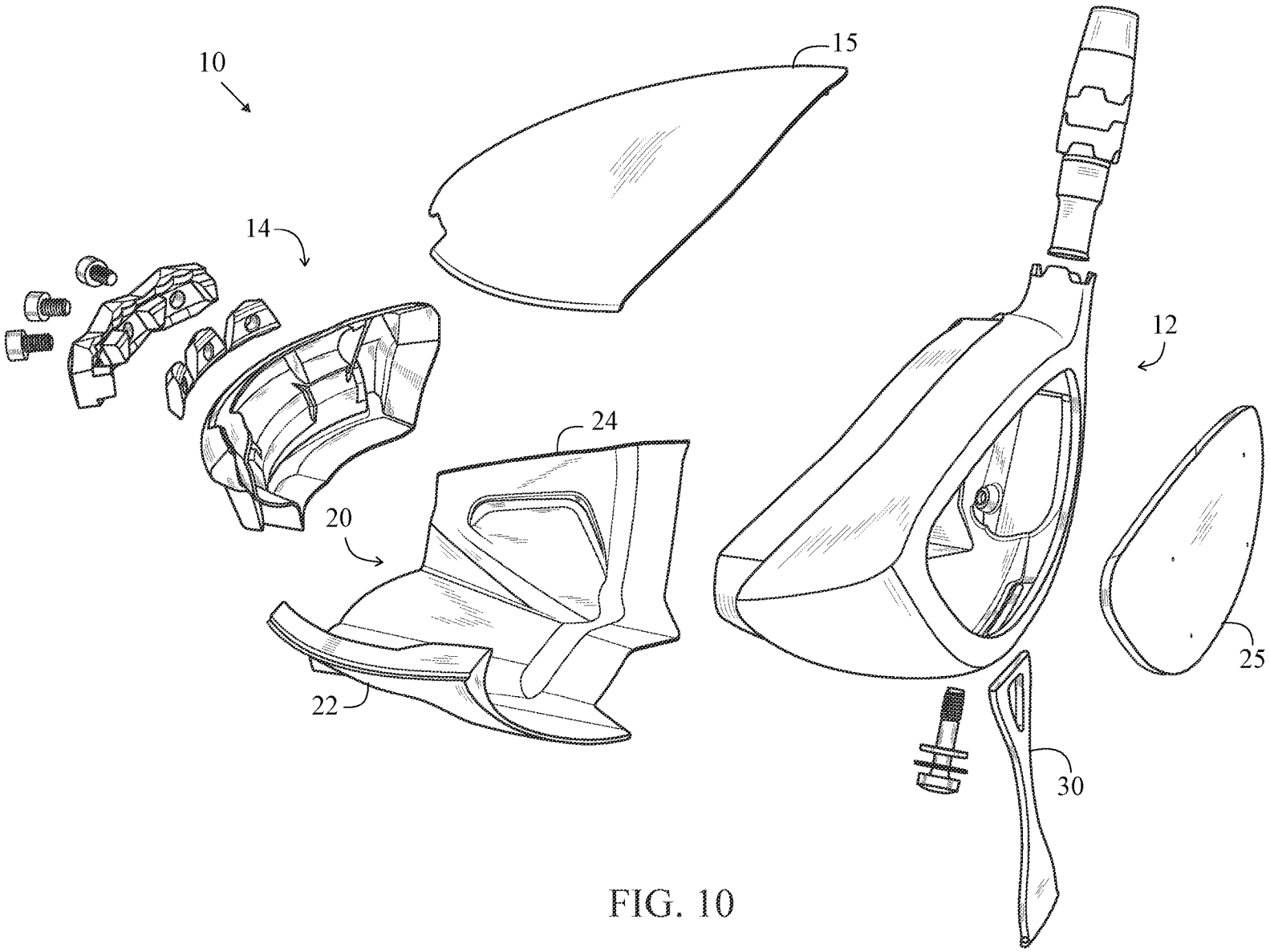
FIG. 10 is an exploded view of a multiple component golf club head
Figure 11:
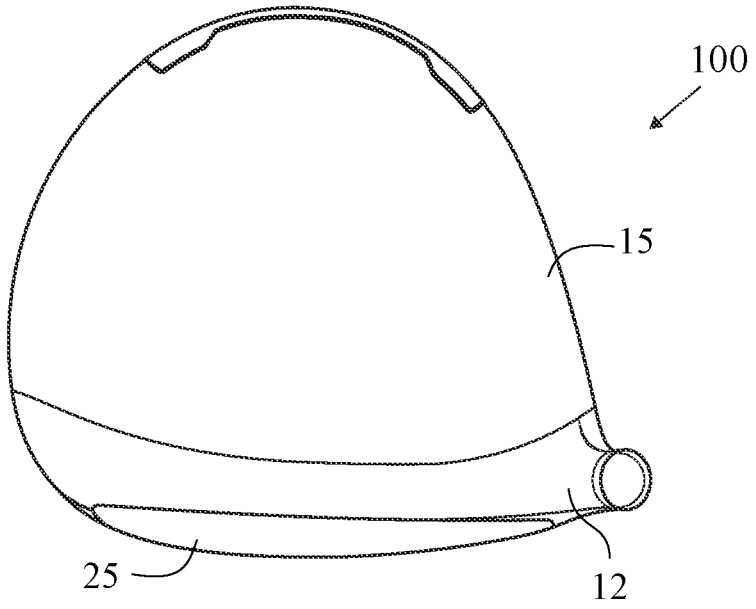
FIG. 11 is a top plan view of a first embodiment of a golf club head.
Figure 12:
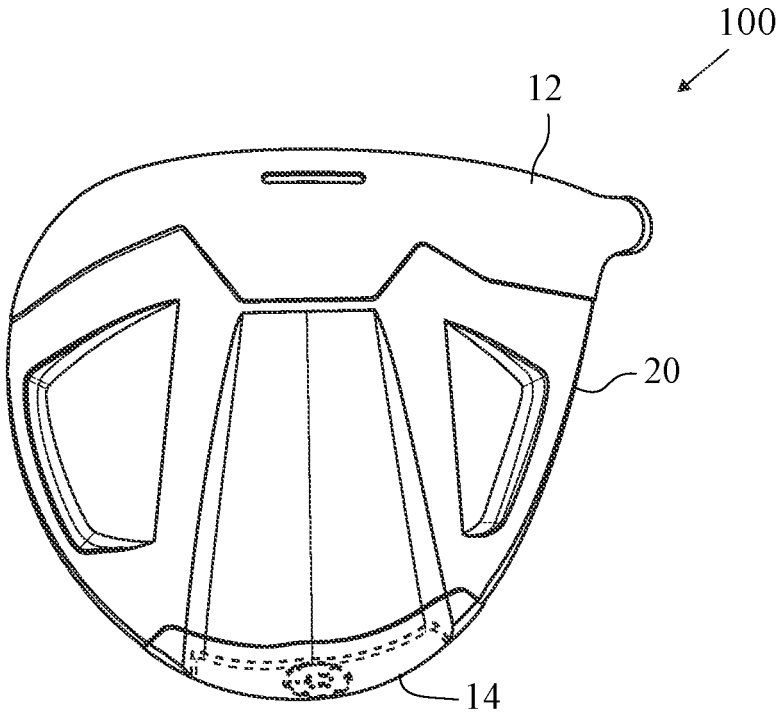
FIG. 12 is a bottom plan view of the golf club head of FIG. 11.
Figure 13:
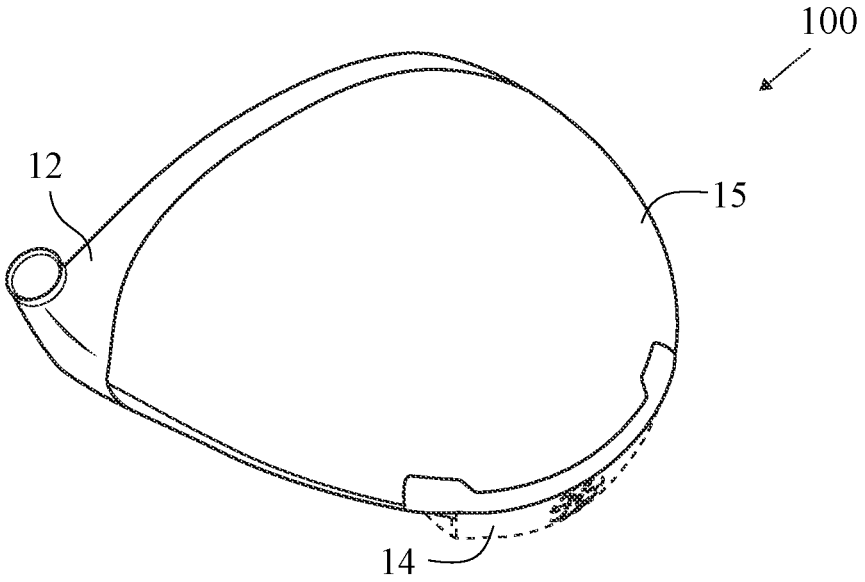
FIG. 13 is a top perspective view of the golf club head of FIG. 11.
Figure 14:
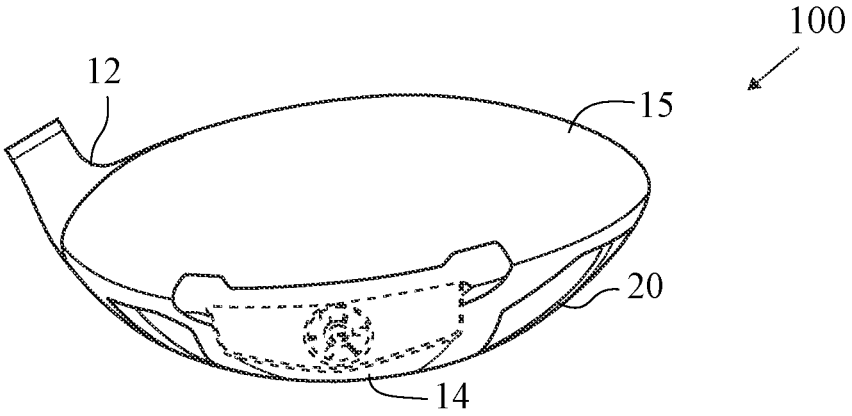
FIG. 14 is a rear elevation view of the golf club head of FIG. 11.
Figure 15:
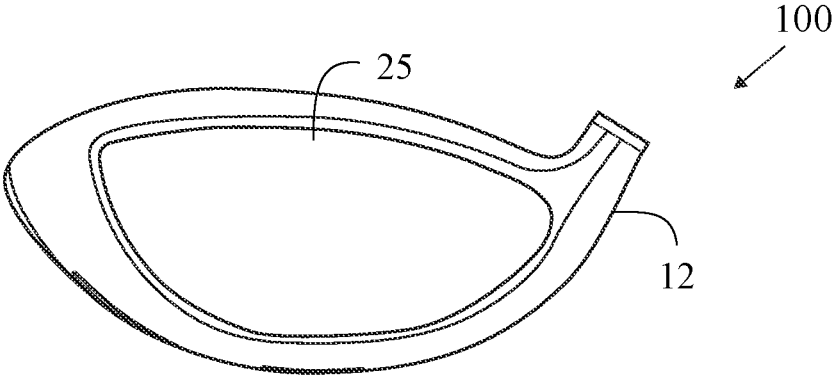
FIG. 15 is a front elevation view of the golf club head of FIG. 11.
Figure 16:
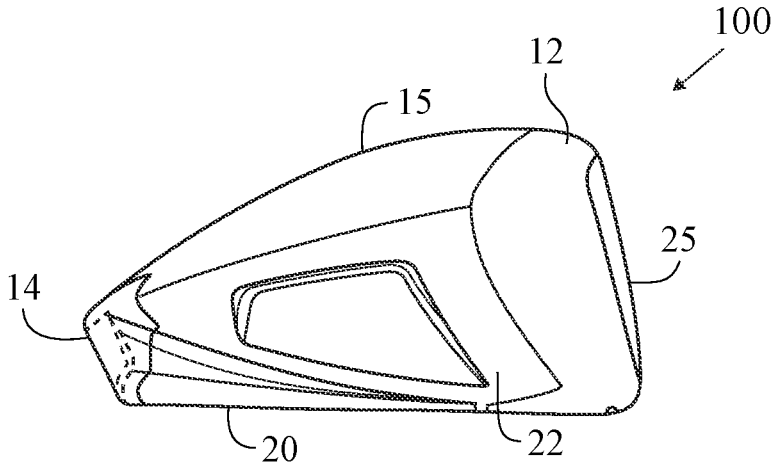
FIG. 16 is a toe-side elevation view of the golf club head of FIG. 11.
Figure 17:
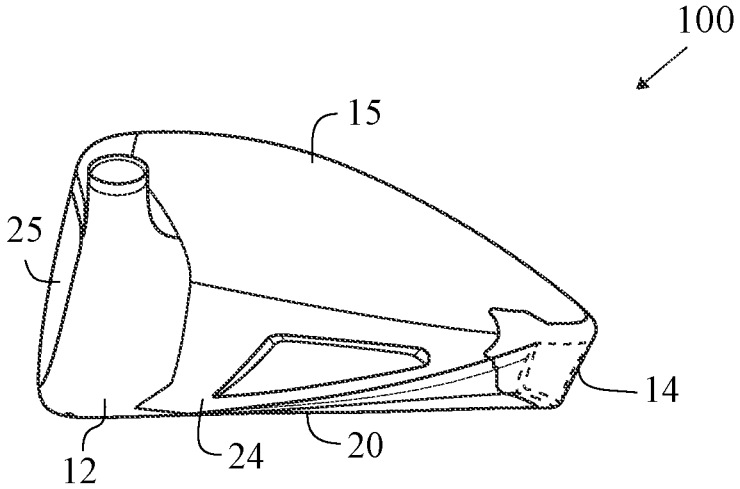
FIG. 17 is a heel-side elevation view of the golf club head of FIG. 11.
Figure 18:
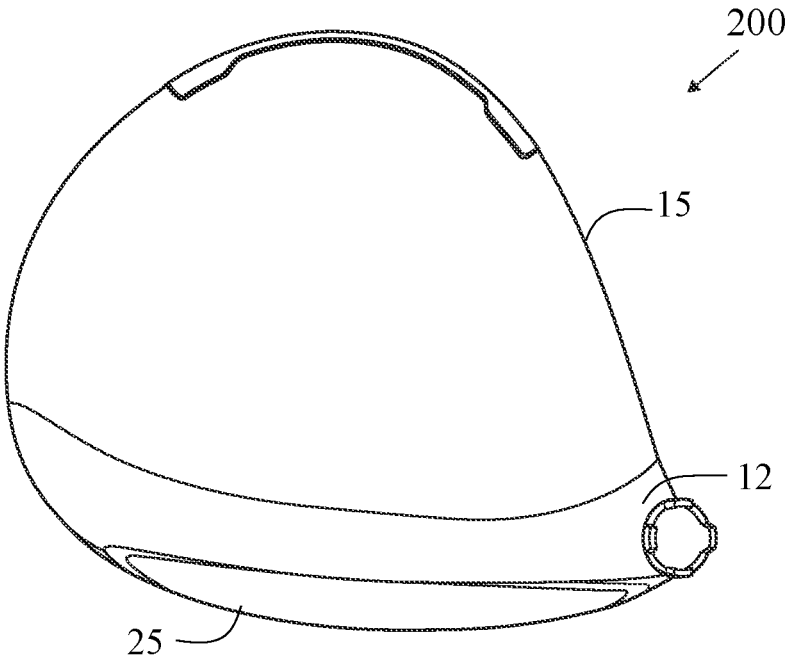
FIG. 18 is a top plan view of a second embodiment of a golf club head.
Figure 19:
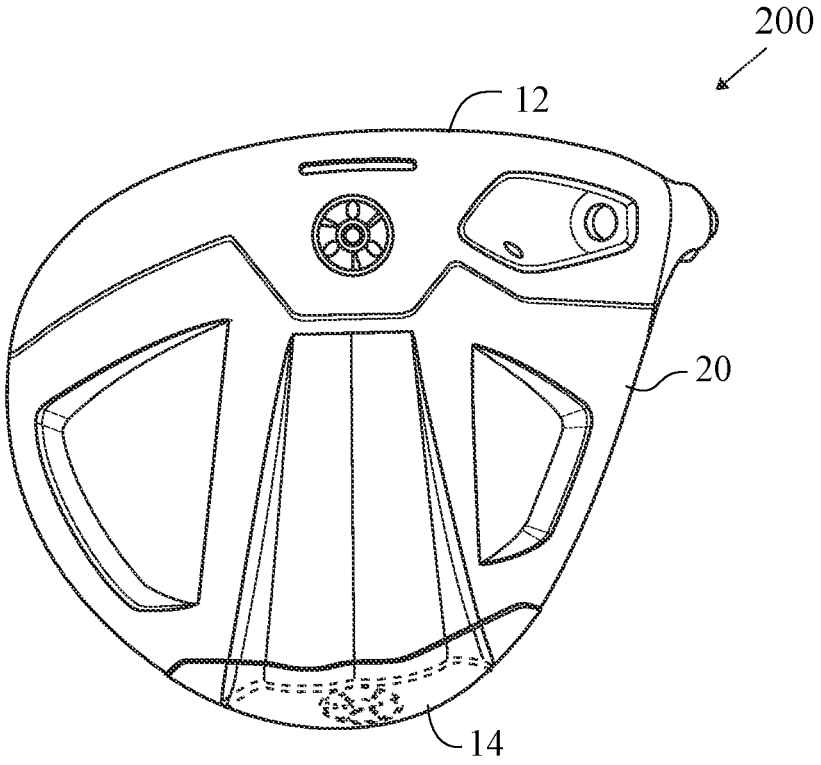
FIG. 19 is a bottom plan view of the golf club head of FIG. 18.
Figure 20:
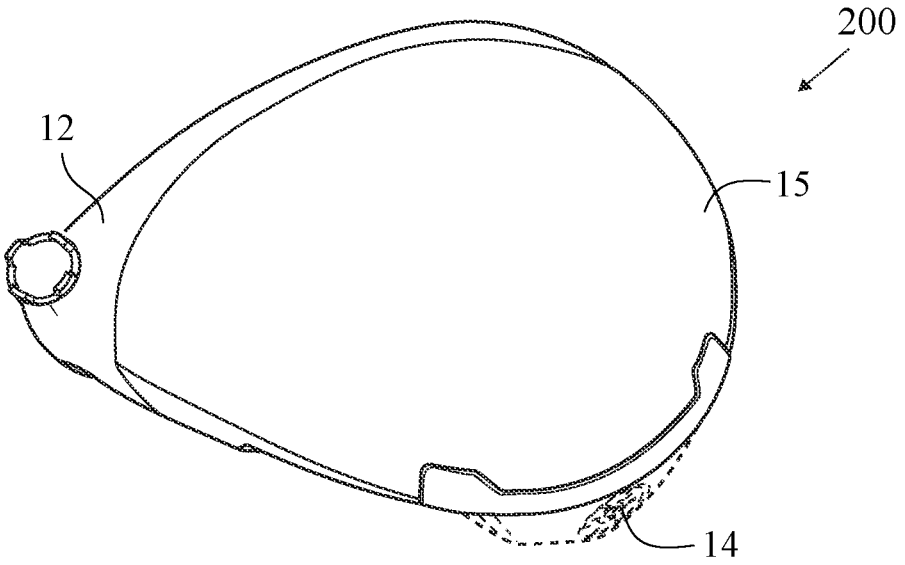
FIG. 20 is a top perspective view of the golf club head of FIG. 18.
Figure 21:
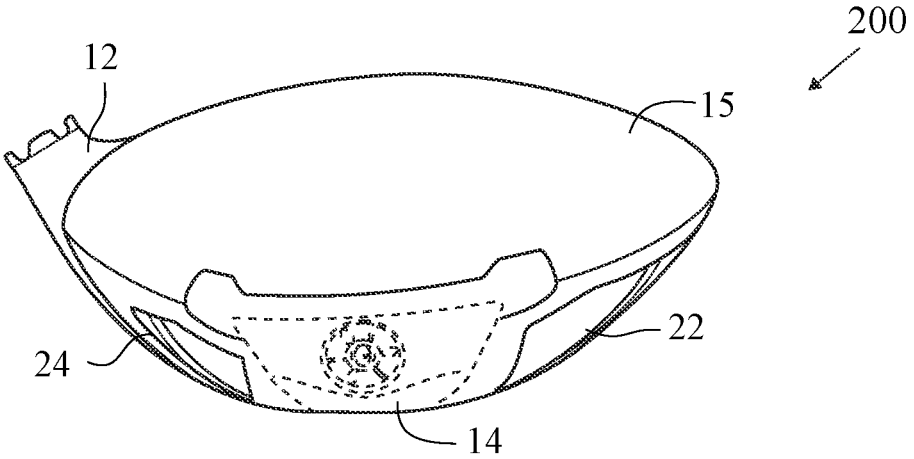
FIG. 21 is a rear elevation view of the golf club head of FIG. 18.
Figure 22:
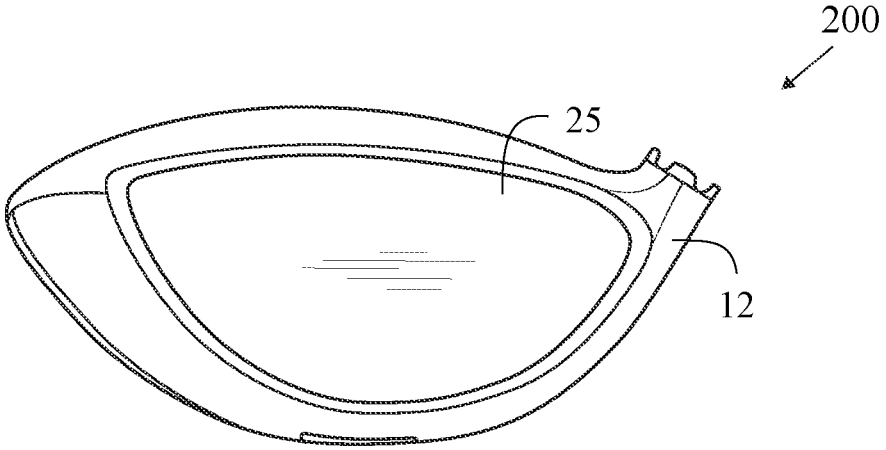
FIG. 22 is a front elevation view of the golf club head of FIG. 18.
Figure 23:
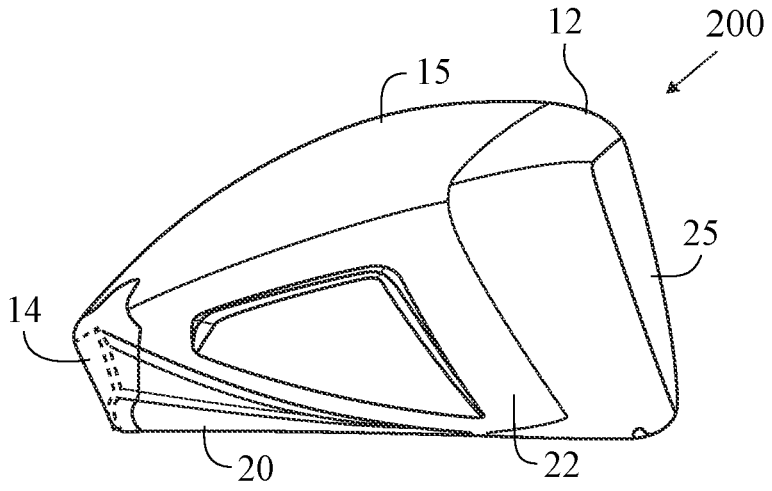
FIG. 23 is a toe-side elevation view of the golf club head of FIG. 18.
Figure 24:
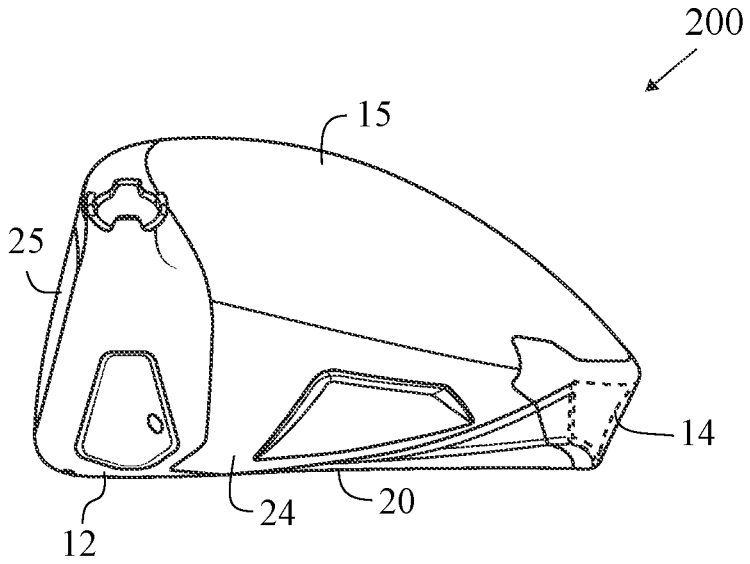
FIG. 24 is a heel-side elevation view of the golf club head of FIG. 18.
Figure 25:
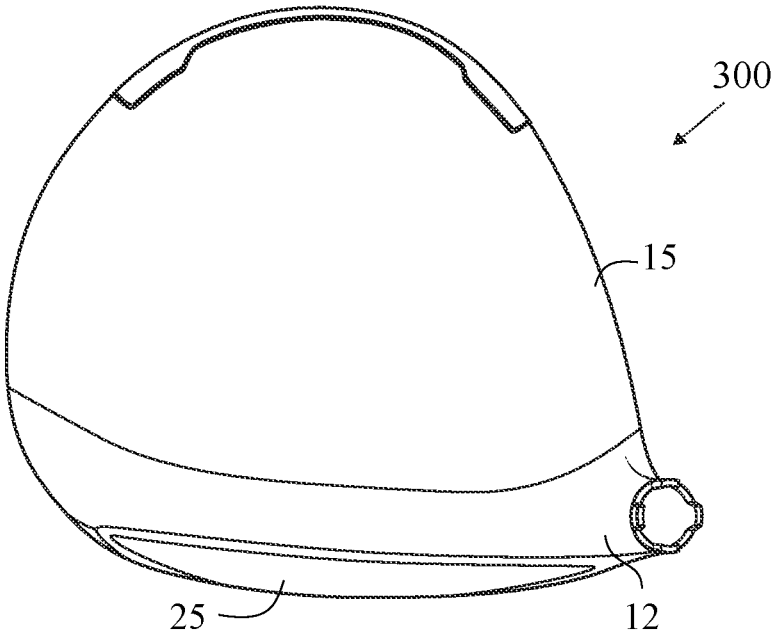
FIG. 25 is a top plan view of a third embodiment of a golf club head.
Figure 26:
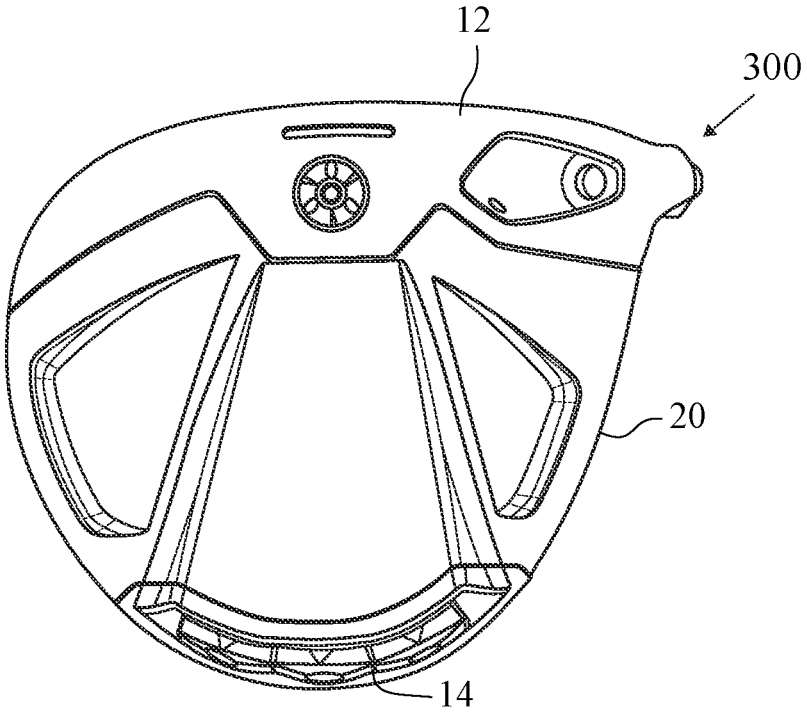
FIG. 26 is a bottom plan view of the golf club head of FIG. 25.
Figure 27:
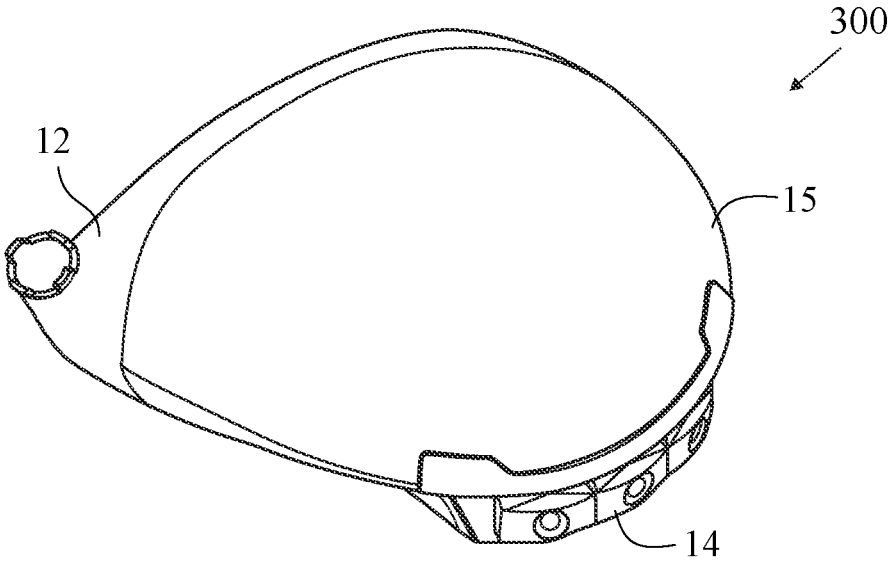
FIG. 27 is a top perspective view of the golf club head of FIG. 25.
Figure 28:
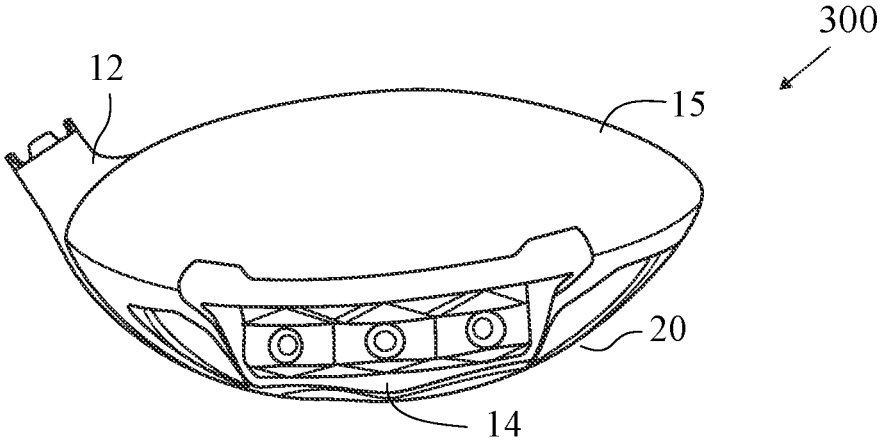
FIG. 28 is a rear elevation view of the golf club head of FIG. 25.
Figure 29:
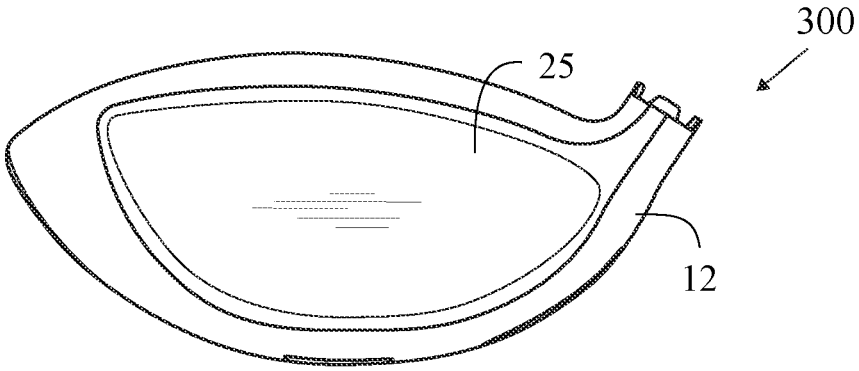
FIG. 29 is a front elevation view of the golf club head of FIG. 25.
Figure 30:
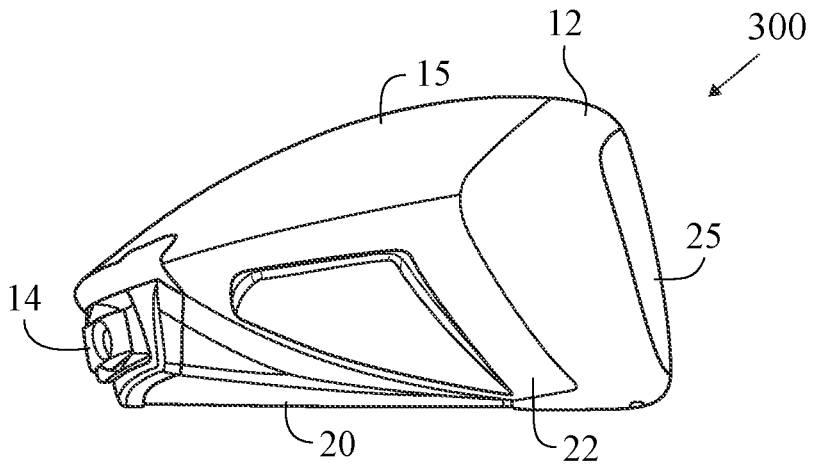
FIG. 30 is a toe-side elevation view of the golf club head of FIG. 25.
Figure 31:
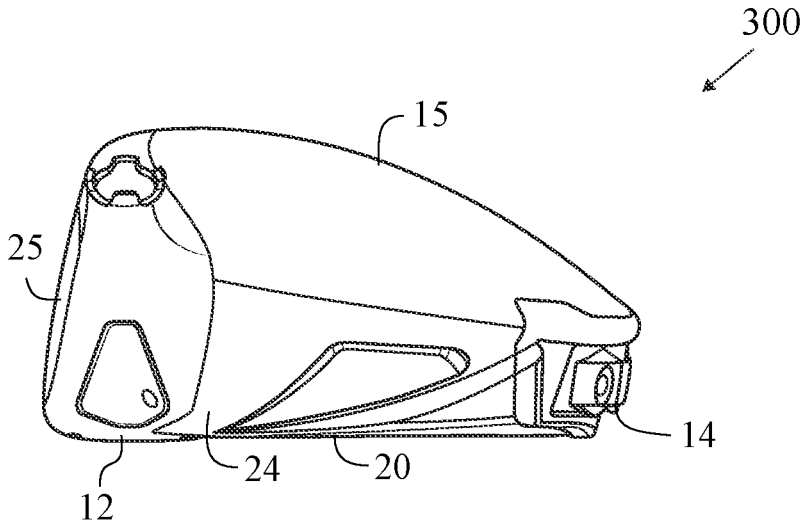
FIG. 31 is a heel-side elevation view of the golf club head of FIG. 25.
Figure 32:
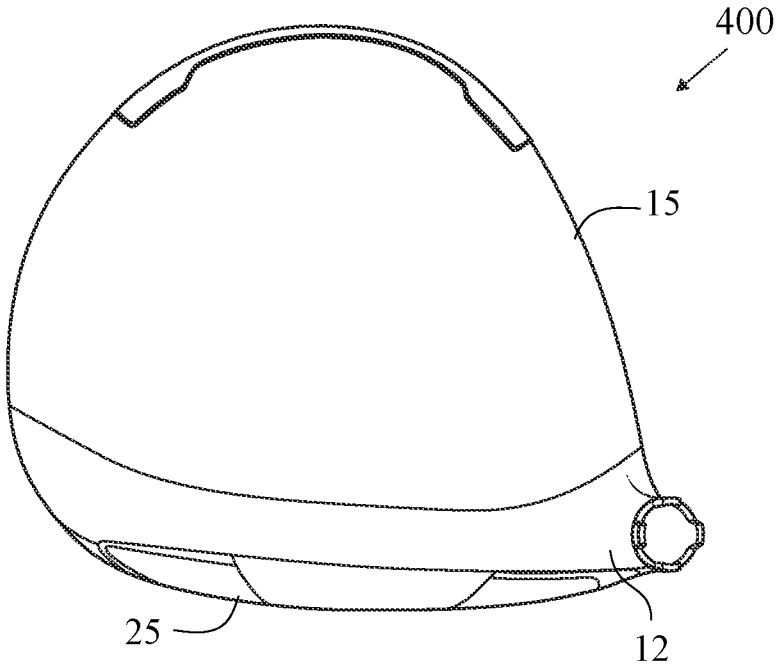
FIG. 32 is a top plan view of a fourth embodiment of a golf club head.
Figure 33:
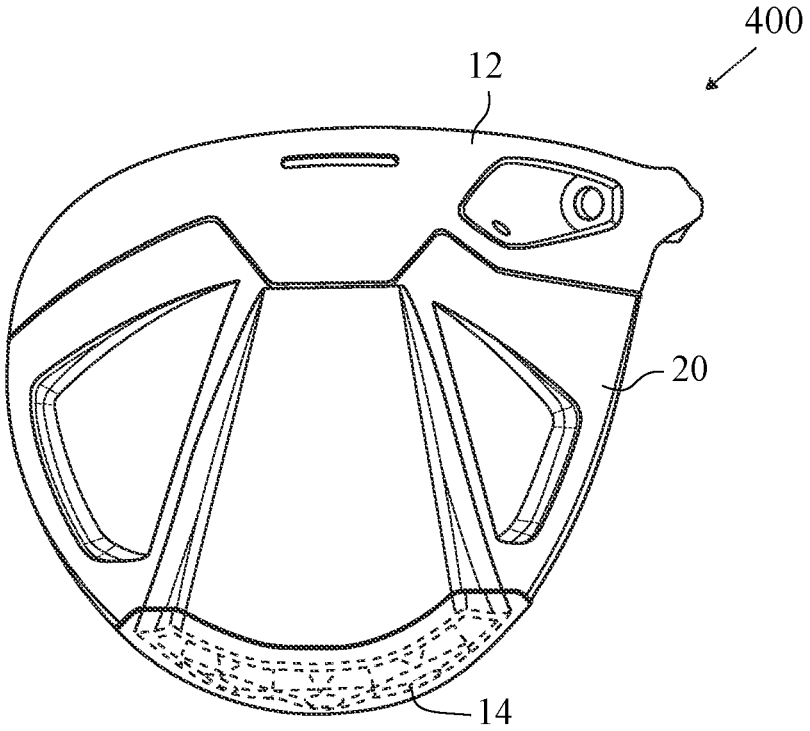
FIG. 33 is a bottom plan view of the golf club head of FIG. 32.
Figure 34:
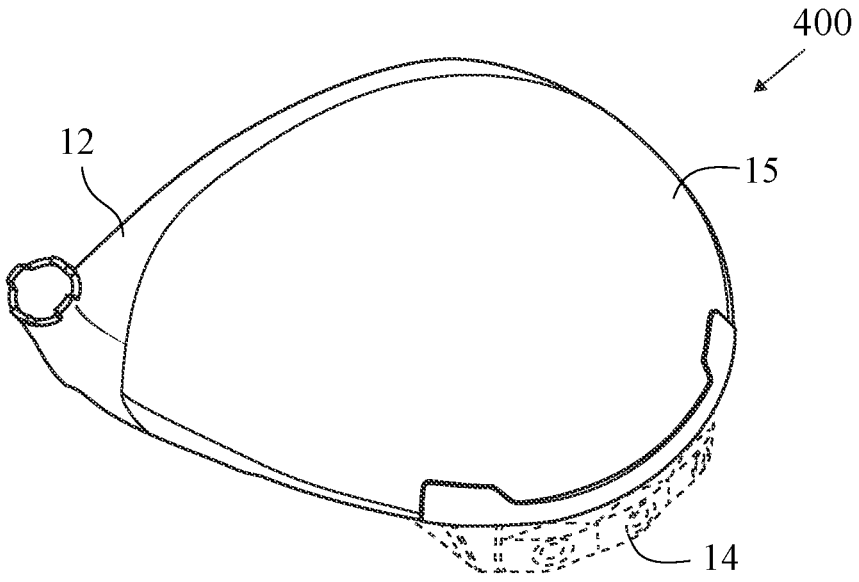
FIG. 34 is a top perspective view of the golf club head of FIG. 32.
Figure 35:
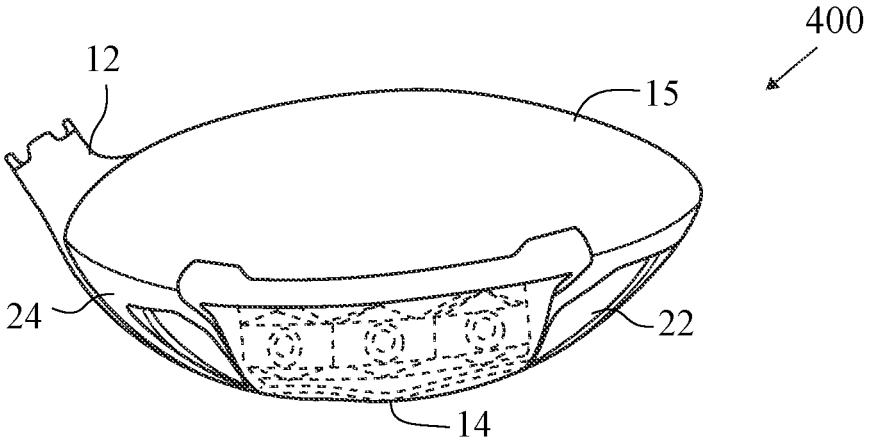
FIG. 35 is a rear elevation view of the golf club head of FIG. 32.
Figure 36:
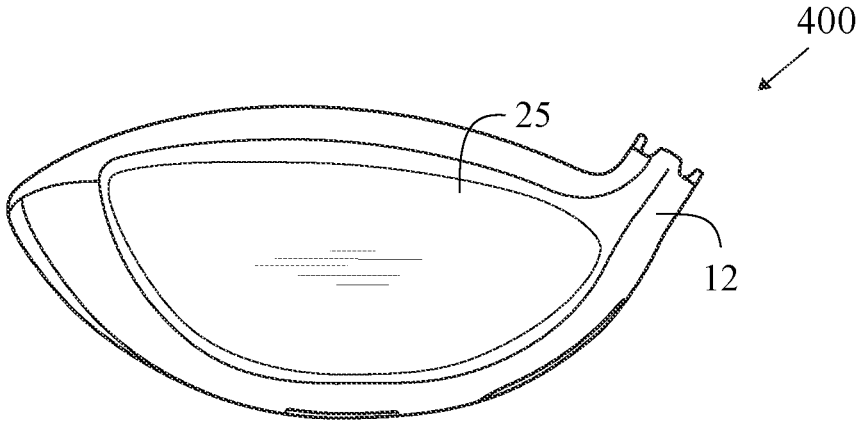
FIG. 36 is a front elevation view of the golf club head of FIG. 32.
Figure 37:
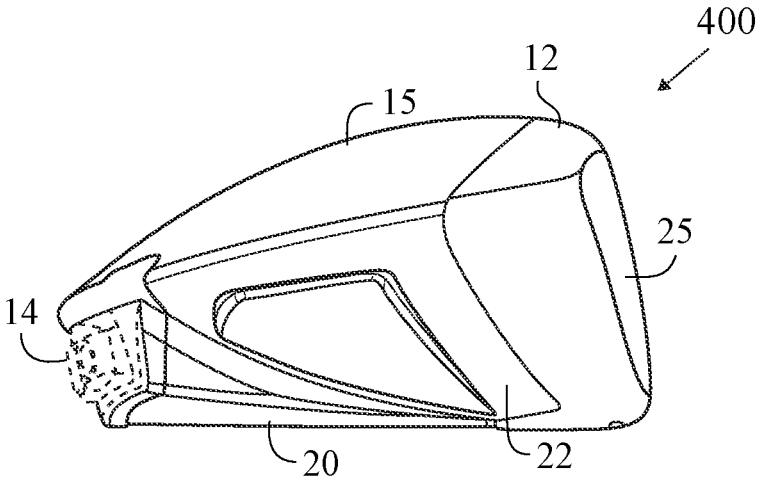
FIG. 37 is a toe-side elevation view of the golf club head of FIG. 32.
Figure 38:
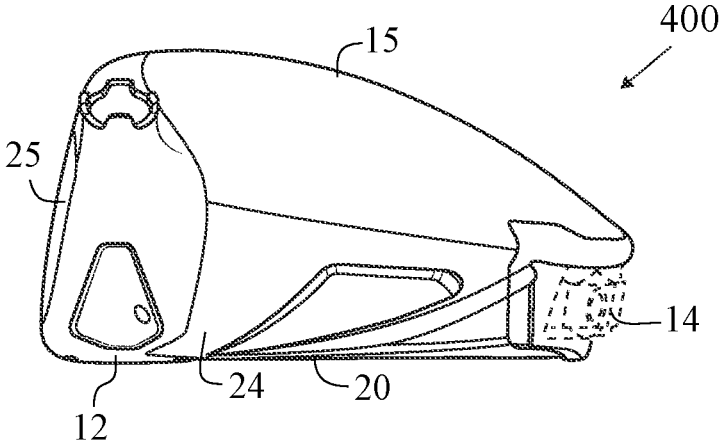
FIG. 38 is a heel-side elevation view of the golf club head of FIG. 32.

The sole portion 20 has a toe edge wall 22 and a heel edge wall 24, as shown in FIGS. 9-10. FIGS. 9-10 are exploded views of a golf club head 10.

The crown portion 15 has a radius of curvature.

The sole portion 20 has a plurality of facets.

In another embodiment, a golf club head 10 comprises a face component 25, a central body component 12, and an aft-component 14, as shown in FIGS. 9-17.

The face component 25 is attached to a front opening of the central body 12 and the aft component 14 is attached to a rear opening of the central body 12.

The central body component 12 comprises a crown portion 15 composed of a continuous carbon fiber reinforced epoxy material, with a thickness ranging from 0.025 inch to 0.040 inch and a sole portion 20 composed of a chopped carbon fiber reinforced vinyl ester sheet molding compound material, with a thickness ranging from 0.040 inch to 0.240 inch. The crown portion 15 is attached to the sole portion 20. The component 5 has a front opening 6 and a rear opening 8 with a hollow interior.

Preferably, the face component 25 is composed of a metal material.

Preferably, the aft-component 14 is composed of a metal material.

Alternatively, the face component 25 is composed of a titanium alloy material.

FIGS. 11-17 illustrate another embodiment of a golf club head 100.

FIGS. 18-24 illustrate another embodiment of a golf club head 200.

FIGS. 25-31 illustrate another embodiment of a golf club head 300.

FIGS. 32-38 illustrate another embodiment of a golf club head 400.

The golf club head 10 includes a body 12 having a sole section 20 that extends away from a lower edge of a striking face section 25, a return section extending away from an upper edge of the striking face section, a hosel for engaging a shaft, a heel end, a toe end, an upper opening, a hollow interior, and an aft end. The area where the return section and sole section connect with the striking face section is known as the hinge region. A crown section is comprised of the return section and a crown insert that is placed over the upper opening to enclose the hollow interior. Within the hollow interior, a stiffening member 30 extends from the sole section upward to the return section. In an alternative embodiment, the stiffening member 30 may extend to the crown insert instead; what is important is that the stiffening member 30 connects the crown section to the sole section and that no part of the stiffening member 30 touches the striking face section 25 or is located more than 1 inch away from an interior surface of the striking face section 25 in a front-to-back direction.

Figure 39:
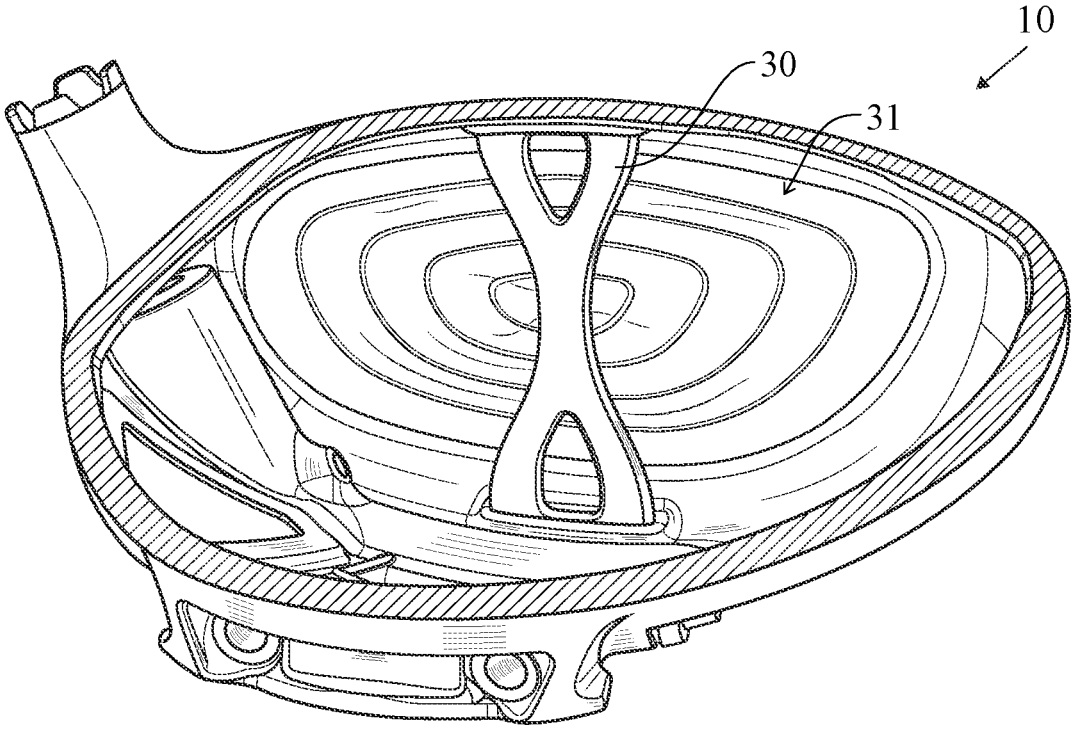
FIG. 39 is an illustration of a first embodiment of a stress relief component.
Figure 40:
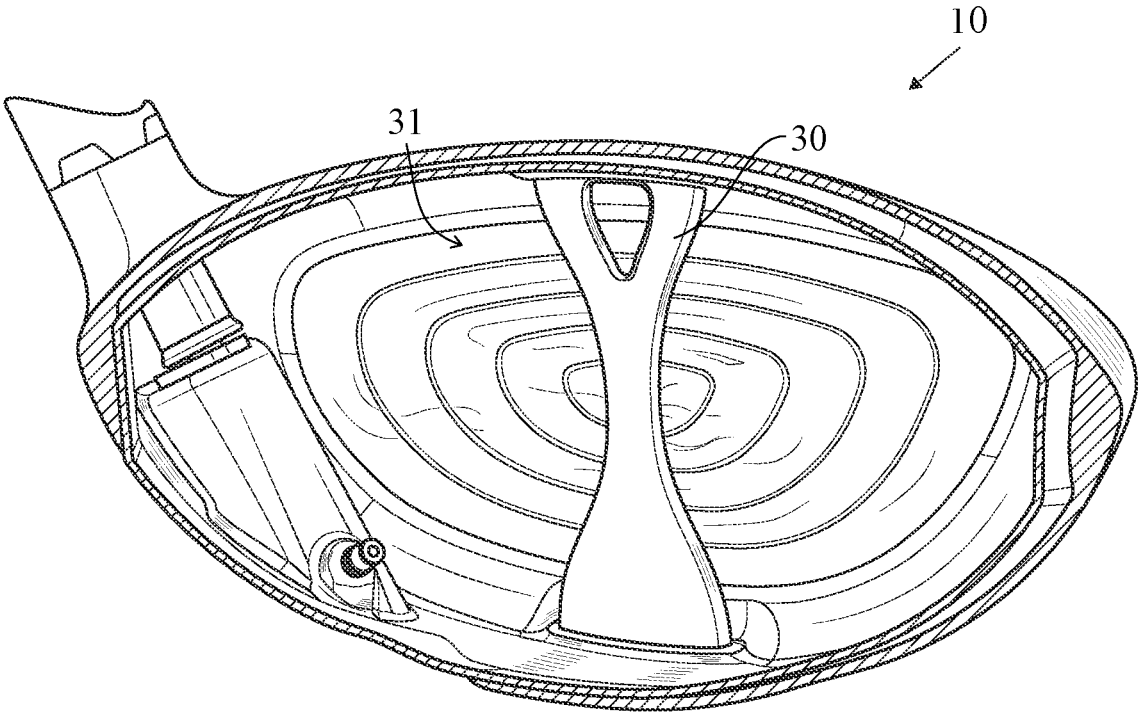
FIG. 40 is an illustration of a second embodiment of a stress relief component.

As shown in FIGS. 39-40, the stiffening member 30 in the preferred embodiment comprises a wishbone structure.

The stiffening member 30 preferably is completely located within 1 inch, and more preferably within 0.500 inch, and most preferably within approximately 0.433 inch of the interior surface 31 of the striking face section 25, measured along a vertical plane extending through the face center perpendicular to the striking face section 25 and in a front-to-back direction. Locating the stiffening member 30 within the region of the golf club head 10 defined above has the greatest stress-reducing effect on the golf club head 10, and particularly the striking face section 25. In a preferred embodiment, the stiffening member 30 has a height ranging from 2 inches to 3 inches, and most preferably 2.25 inches to 2.75 inches. In a preferred embodiment, the stiffening member 30 has a narrowest width at a center, which preferably ranges from 0.1 inch to 0.25 inch, and a widest width at a bottom, which preferably ranges from 0.5 inch to 1.0 inch.

The stiffening member 30 of the present invention may be used as described herein in any type of golf club head with a hollow interior, including putters, irons, wedges, hybrids, fairway woods, and drivers. In any of the embodiments disclosed herein, when the golf club head 10 is designed as a driver, it preferably has a volume from 200 cubic centimeters to 600 cubic centimeters, more preferably from 300 cubic centimeters to 500 cubic centimeters, and most preferably from 420 cubic centimeters to 470 cubic centimeters, with a most preferred volume of 460 cubic centimeters. In fact, in the preferred embodiment, the golf club head 10 has a volume of approximately 450 cc to 460 cc. The volume of the golf club head 10 will also vary between fairway woods (preferably ranging from 3-woods to eleven woods) with smaller volumes than drivers. When designed as a driver, the golf club head 10 preferably has a mass of no more than 215 grams, and most preferably a mass of 180 to 215 grams; when designed as a fairway wood, the golf club head 10 preferably has a mass of 135 grams to 200 grams, and preferably from 140 grams to 165 grams. The mass of the body, and thus the overall discretionary mass of the golf club head 10, can be adjusted by creating a cutout in the sole section and filling it with an insert composed of a lightweight material such as carbon composite, plastic, or a low density metal alloy. Similarly, the crown insert can be formed of a carbon composite material to free up additional discretionary mass.

Figure 41:
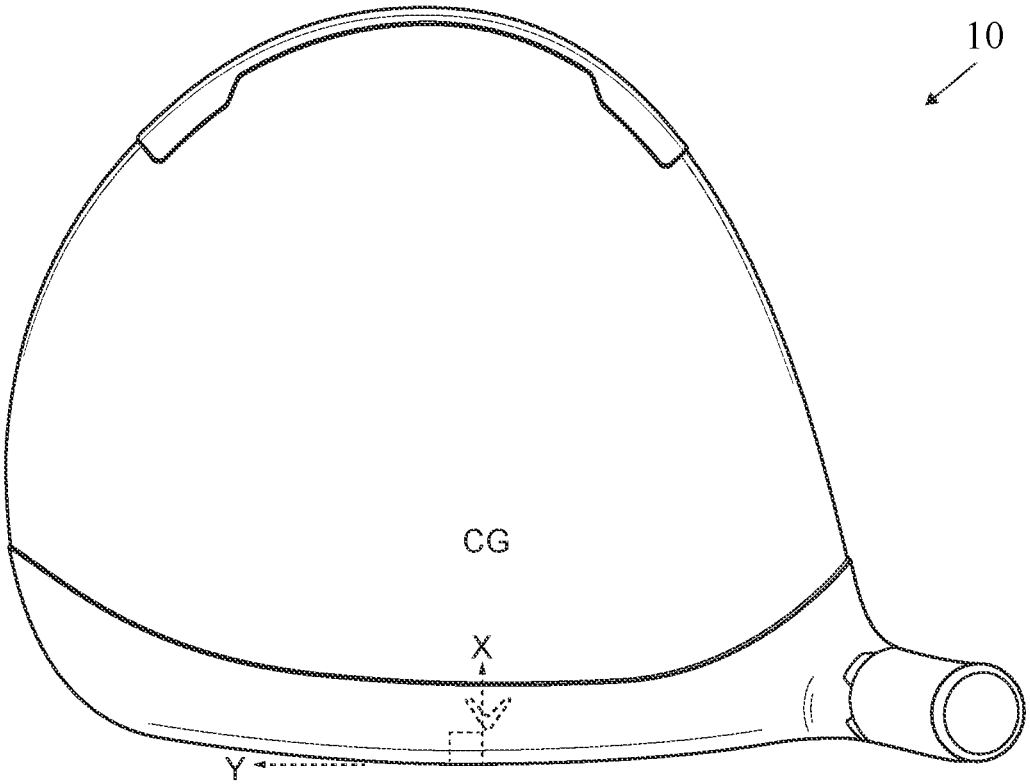
FIG. 41 is a top plan view of a golf club head showing a CG location.
Figure 42:
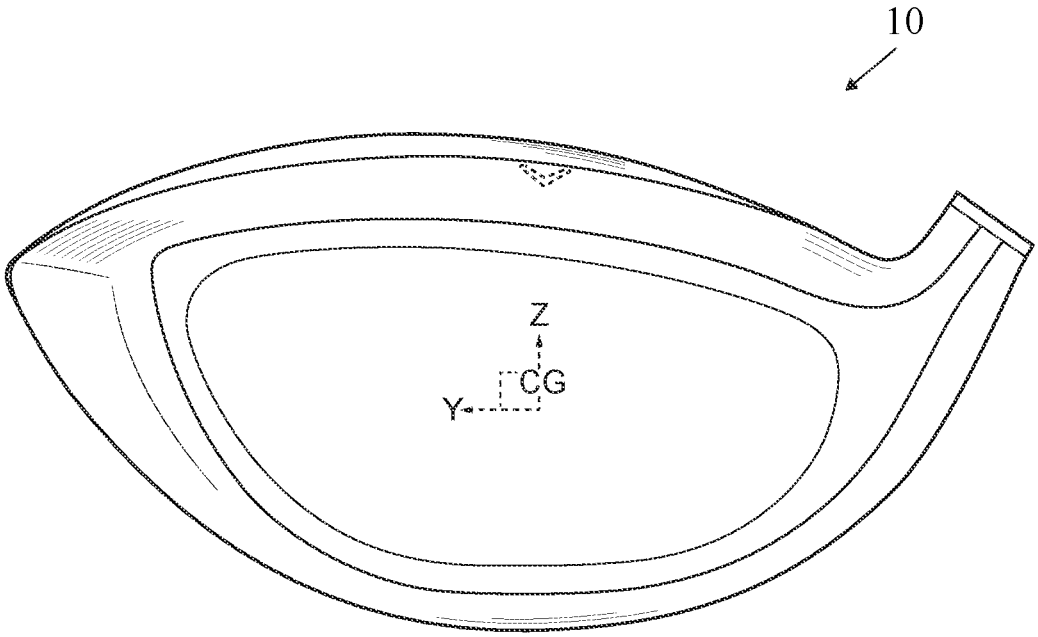
FIG. 42 is a front elevation view of a golf club head showing a CG location.

The axes of inertia are designated X, Y and Z, as shown in FIGS. 41-42. The X axis extends from the striking plate insert through the center of gravity (CG), and to the rear of the golf club head 10. The Y axis extends from the toe end of the golf club head 10 through the center of gravity, CG, and to the heel end of the golf club head 10. The Z axis extends from the crown through the center of gravity, CG, and to the sole.

As defined in Golf Club Design, Fitting, Alteration & Repair, 4th Edition, by Ralph Maltby, the center of gravity, or center of mass, of the golf club head is a point inside of the club head determined by the vertical intersection of two or more points where the club head balances when suspended. A more thorough explanation of this definition of the center of gravity is provided in Golf Club Design, Fitting, Alteration & Repair.

The center of gravity and the moment of inertia of a golf club head 10 are preferably measured using a test frame ($X^T$, $Y^T$, $Z^T$), and then transformed to a head frame ($X^H$, $Y^H$, $Z^H$). The center of gravity of a golf club head may be obtained using a center of gravity table having two weight scales thereon, as disclosed in U.S. Pat. No. 6,607,452, entitled High Moment Of Inertia Composite Golf Club, and hereby incorporated by reference in its entirety. If a shaft is present, it is removed and replaced with a hosel cube that has a multitude of faces normal to the axes of the golf club head. Given the weight of the golf club head, the scales allow one to determine the weight distribution of the golf club head when the golf club head is placed on both scales simultaneously and weighed along a particular direction, the X, Y or Z direction.

In general, the moment of inertia, Izz, about the Z axis for the golf club head 10 of the present invention is preferably greater than 4000 g-cm$^2$, and more preferably greater than 5000 g-cm$^2$, and preferably ranges from 4500 g-cm$^2$ to 6000 g-cm$^2$. The moment of inertia, Iyy, about the Y axis for the golf club head 10 of the present invention is preferably in the range from 2500 g-cm$^2$ to 4000 g-cm$^2$, more preferably from 3000 g-cm$^2$ to 3500 g-cm$^2$. The moment of inertia, Ixx, about the X axis for the golf club head 10 of the present invention is preferably in the range from 2000 g-cm$^2$ to 3500 g-cm$^2$, more preferably from 2500 g-cm$^2$ to 3300 g-cm$^2$.

At least one of the products of inertia (Iyz and Ixz) of the golf club head have an absolute value below 300 g-cm$^2$. Preferably, the absolute value of the products of inertia Iyz is preferably between 50 g-cm$^2$ and 200 g-cm$^2$, and most preferably between 50 g-cm$^2$ and 125 g-cm$^2$.

A more detailed discussion of the products of inertia is disclosed in Cackett et al., U.S. Pat. No. 6,669,580 for a Golf Club Head That Optimizes Products Of Inertia, which is hereby incorporated by reference in its entirety.

Individual layers or plies in the composite laminate may be comprised of a unidirectional (UD) composite layer or a fabric consistent of a bi-axial of tri-axial woven composite. For the purpose of this invention, the fiber reinforcement in the composite material system may include carbon, fiberglass, aramid or any combination of the three.

The number of layers or plies in a stack of a composite laminate of the present invention can vary between 2 and 200 plies. Each composite ply may be a composite of either UD, bi-axial or tri-axial woven composite. The fabric area weight (FAW) of each composite ply can range from 20 gsm up to 500 gsm. The fiber reinforcement in the composite material for each ply may include carbon, fiberglass, aramid or any combination of the three. The matrix material that is combined with the fiber bundles of each ply to create the composite material of the present invention can be of a thermosetting (epoxy, polyester, vinyl ester, etc.) or a thermoplastic (nylon, polycarbonate, PPS, PEKK, PEEK, etc.) material.

Composite Laminate – *SMC*

In some embodiments, the composite may be sheet molding compound (SMC), which may be comprised of chopped fibers. Each chopped fiber has a length less than 0.0625 or a length that is no less than 2 inches and no more than 4 inches.

The SMC of the present invention has the following qualities: the fiber reinforcement of the SMC may include carbon, fiberglass, aramid or any combination of the three; the matrix material that is combined with the fiber bundles of each ply to create the composite material of the present invention can be a thermosetting (epoxy, polyester, vinyl ester, etc.) or a thermoplastic (nylon, polycarbonate, PPS, PEKK, PEEK, etc.) material; and the thickness of the SMC may vary between 0.015" to 0.250".

Composite Laminate+*SMC*.

As it pertains to this invention, the use of continuous and discontinuous materials may be used within the same composite component. Following equation 2, the Contiuous Fiber_Ratio quantifies the amount of continuous fiber there is in the laminate compared to the discontinuous fiber or SMC.

VACNTs can be placed at the interface of composite plies in order to improve interlaminar shear strength while also improving overall fatigue life. VACNTs bridge the various composite plies, improving the interlaminar properties of the interfaces as well as arresting crack propagation or pre-failure modes at the interlaminar level. As it relates to this invention, the length of the VACNTs may vary between 5 and 50 μm. VACNTs of the present invention have the following qualities: the VACNTs height can vary between 5 and 50 μm; the VACNTs are applied on a single side of a composite ply; the VACNTs are applied on both sides of a composite ply; and the Additive_Laminate_Ratio can vary between 0.05 and 0.90.

In each of the embodiments disclosed herein, a face component 25 is preferably cast from molten metal in a method such as the well-known lost-wax casting method. The metal for casting is preferably titanium or a titanium alloy such as 6-4 titanium alloy, alpha-beta titanium alloy or beta titanium alloy for forging, and 6-4 titanium for casting. Alternatively, the face component 25 is composed of 17-4 steel alloy. Additional methods for manufacturing the face component include forming the body from a flat sheet of metal, super-plastic forming the face component from a flat sheet of metal, machining the face component from a solid block of metal, electrochemical milling the face component from a forged pre-form, casting the body using centrifugal casting, casting the face component using levitation casting, and like manufacturing methods.

The golf club head 10 preferably has a characteristic time (CT) of the striking face section 25 close to, but not exceeding, the 257 microsecond ("μS") limit set by the USGA, and the striking face section 25 preferably has a varying thickness such as that described in U.S. Pat. No. 7,448,960, for a Golf Club Head With Variable Face Thickness, which pertinent parts are hereby incorporated by reference. Other alternative embodiments of the thickness of the striking face section 25 are disclosed in U.S. Pat. No. 6,398,666, for a Golf Club Striking Plate With Variable Thickness, U.S. Pat. No. 6,471,603, for a Contoured Golf Club Face and U.S. Pat. No. 6,368,234, for a Golf Club Striking Plate Having Elliptical Regions Of Thickness, all of which are owned by Callaway Golf Company and which are hereby incorporated by reference. Alternatively, the striking face section 25 has a uniform thickness.

In other embodiments, the golf club head 10 may have a multi-material composition such as any of those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

Seluga et al., U.S. Pat. No. 9,757,629 for a Golf Club Head Having Stress Reducing Features is hereby incorporated by reference in its entirety.

Seluga et al., U.S. Pat. No. 9,776,058 for a Golf Club Head Having Optimized Ball Speed To CT Relationship is hereby incorporated by reference in its entirety.

Seluga et al., U.S. Pat. No. 11,433,281 for a Method For Manufacturing Golf Club Head Having Stress Reducing Features is hereby incorporated by reference in its entirety.

Gibbs et al., U.S. Pat. No. 11,433,282 for a Method For Manufacturing Golf Club Head Having Stress Reducing Features is hereby incorporated by reference in its entirety.

Davis et al., U.S. Pat. No. 11,400,349 for Golf Club Head With Heel And Toe Stiffeners is hereby incorporated by reference in its entirety.

Nunez et al., U.S. Pat. No. 11,364,423 for a Golf Club Head Having Stress Reducing Features is hereby incorporated by reference in its entirety.

DeMille et al., U.S. Pat. No. 11,331,544 for Binder Jet Printed Golf Club Components With Lattice Structures is hereby incorporated by reference in its entirety.

Westrum et al., U.S. Pat. No. 11,090,534 for a Golf Club Head Comprising Microscopic Bubble Material is hereby incorporated by reference in its entirety.

Frederickson, U.S. Pat. No. 11,083,939 for a Golf Club Head With Adjustable Sole Weight is hereby incorporated by reference in its entirety.

Del Rosario et al., U.S. Pat. No. 11,027,176 for a Golf Club Head With Hosel Support Structural is hereby incorporated by reference in its entirety.

Hanhart et al., U.S. Pat. No. 10,912,970 for a Golf Club Head Having Adjustable Stress Reducing Features is hereby incorporated by reference in its entirety.

Frederickson, U.S. Pat. No. 10,716,984 for a Golf Club Head With Adjustable Center Of Gravity is hereby incorporated by reference in its entirety.

DeMille et al., U.S. Pat. No. 10,105,579 for a Golf Club Head With A Compression-Molded, Thin-Walled Aft-Body is hereby incorporated by reference in its entirety.

Seluga, U.S. Pat. No. 10,099,096 for a Golf Club Head With Center Of Gravity Adjustability That Optimizes Products Of Inertia is hereby incorporated by reference in its entirety.

Seluga, U.S. Pat. No. 9,968,834 for a Golf Club Head With Adjustable Center Of Gravity is hereby incorporated by reference in its entirety.

DeMille et al., U.S. Pat. No. 9,283,447 for a Golf Club Head With Composite Face is hereby incorporated by reference in its entirety.

Griffin et al., U.S. Pat. No. 9,381,409 for a Multiple Material Iron is hereby incorporated by reference in its entirety.

DeMille et al., U.S. Pat. No. 9,387,373 for a Golf Club Head With Composite Weight Port is hereby incorporated by reference in its entirety.

Rice et al., U.S. Pat. No. 9,468,819 for a Golf Club Head is hereby incorporated by reference in its entirety.

U.S. Pat. No. 10,238,933 is hereby incorporated by reference in its entirety.

U.S. Pat. No. 9,259,627 is hereby incorporated by reference in its entirety.

U.S. Pat. No. 9,180,349 is hereby incorporated by reference in its entirety.

U.S. Pat. No. 8,834,294 is hereby incorporated by reference in its entirety.

U.S. Pat. No. 9,352,199 is hereby incorporated by reference in its entirety.

U.S. Pat. No. 9,067,110 is hereby incorporated by reference in its entirety.

U.S. Pat. No. 9,345,936 is hereby incorporated by reference in its entirety.

U.S. Pat. No. 8,956,244 is hereby incorporated by reference in its entirety.

The materials used to make the various parts of the inventive golf club head 10 may vary, but in the preferred embodiment, each part of the stiffening members 30 preferably is composed of a solid, lightweight, strong metal material such as titanium alloy or steel. In an alternative embodiment, one or more of the parts of the stiffening members 30 can be composed of a lightweight metal or a composite material. The body 12 is preferably cast from molten metal in a method such as the lost-wax casting method. The metal for casting is preferably titanium or a titanium alloy such as 6-4 titanium alloy, alpha-beta titanium alloy or beta titanium alloy for forging, and 6-4 titanium for casting. Alternatively, the body 12 is composed of 17-4 steel alloy. Additional methods for manufacturing the body 12 include forming the body 12 from a flat sheet of metal, super-plastic forming the body from a flat sheet of metal, machining the body 12 from a solid block of metal, electrochemical milling the body 12 from a forged pre-form, casting the body 12 using centrifugal casting, casting the body 12 using levitation casting, and like manufacturing methods.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims.

We claim:

1. A golf club head comprising:

a face component with a stiffening member;

a central body component comprising a crown portion composed of a first carbon based material, a sole portion composed of a second carbon based material, wherein the crown portion is attached to the sole portion, wherein the component has a front opening and a rear opening with a hollow interior;

an aft-component;

wherein the face component is attached to a front opening of the central body and the aft component is attached to a rear opening of the central body;

wherein the golf club head has an absolute value of an Iyz product of inertia less than 125 g-cm$^2$;

wherein the golf club head has an Izz moment of inertia ranging from 4500 g-cm$^2$ to 6000 g-cm$^2$;

wherein the first carbon based material has continuous fibers and the second carbon based material has chopped fibers.

2. The golf club head according to claim 1 wherein the golf club head has an Iyy moment of inertia ranging from 2500 g-cm$^2$ to 4000 g-cm$^2$.

3. The golf club head according to claim 1 wherein the golf club head has an Ixx moment of inertia ranging from 2000 g-cm$^2$ to 3500 g-cm$^2$.

* * * * *